US006006784A

United States Patent [19]

Tsutsui et al.

[11] Patent Number: 6,006,784

[45] Date of Patent: Dec. 28, 1999

[54] AUTOMATIC WATER FAUCET

[75] Inventors: Hidetaka Tsutsui, Urayasu; Makoto Kodaira, Setagaya-ku; Noboru Nakajima, Yokohama, all of Japan

[73] Assignee: Uro Denshi Kogyo Kabushiki Kaisha, Tokyo, Japan

[21] Appl. No.: 09/175,439

[22] Filed: Oct. 20, 1998

[30] Foreign Application Priority Data

May 22, 1998 [JP] Japan ..... 10-141743

[51] Int. Cl.[6] ..... E03C 1/04; E03C 1/05

[52] U.S. Cl. ..... 137/801; 4/623; 4/678; 137/359; 251/129.04; 251/149.1

[58] Field of Search ..... 4/623, 678; 137/329.1, 137/359, 614.05, 801; 251/129.04, 149.1

[56] References Cited

U.S. PATENT DOCUMENTS 1,383,272 6/1921 Woore ..... 137/329.1 X 5,699,832 12/1997 Burchard et al. ..... 137/801 X

*Primary Examiner*—Gerald A. Michalsky

*Attorney, Agent, or Firm*—Jacobson, Price, Holman & Stern, PLLC

[57] ABSTRACT

An automatic water faucet in which the neck portion can be easily attached to the sink, after a common base for receiving the faucet has been attached. To achieve such a purpose, the automatic water faucet comprises a water faucet seat and a neck portion. The water faucet seat is constructed to engage with the neck portion by inserting the neck portion into the water faucet seat and rotating the former repeatedly to the latter so as to assemble them together.

7 Claims, 18 Drawing Sheets

AUTOMATIC WATER FAUCET

BACKGROUND OF THE INVENTION

1. Field of the Invention

This invention relates to a water faucet for a sink or washstand, particularly to an automatic water faucet of the sensor type and how the faucet is attached to the sink.

2. Prior Art

Conventionally, water faucets are attached to sinks (or washstands) as follows: First, a hole is bored near the sink. Next, the base of the faucet is lowered into the hole. A nut is then screwed onto the screw formed on the outside of the base of the faucet and tightened until the facet flange presses tightly against the sink. Then, a tap is attached to the pipe providing water to the sink and a further pipe is connected between this tap and the faucet.

Such taps are attached to allow the water to be turned off when the faucet is being repaired while still allowing the other taps in the house to be used, thereby preventing other users of the water in the building from being affected.

FIG. 18 shows a conventional domestic-use faucet, and indicates the mouth 1, the shut-off valve 2, the attachment flange 3, the threaded portion 4, and the connecting portion 5. This faucet is fixed to the sink by a nut 7 screwed over a washer onto the threaded portion 4. The water supply pipe is connected to the end of this.

FIG. 19 is an explanatory view of a conventional sensor type automatic water faucet attached to a sink. The structure of this faucet differs from that of the conventional faucet as shown in FIG. 18 in that a sensor 8 for detecting hands is provided near the mouth and an electric cable 9 with a connector 10 is provided for connecting the sensor with the controller. Since this water faucet is an automatic type, there is no water shut-off valve 2 as shown in FIG. 18. The electric cable 9 is enclosed in a flexible metal pipe (spiral tube) to prevent it from being cut in an act of vandalism.

The washer 6 is not flat but of a conal shape. This cone-shaped washer 6 is used to allow the electric cable 9 to pass through the washer 6 when the nut 5 is tightened. Reference numeral 13 indicates the thickness of the sink. The O ring 11 serves to prevent water leaking through gap between the mouth and the sink. Although it is not indicated here, an O ring is also used in the faucet in FIG. 18.

FIG. 20 shows a conventional sensor type automatic water faucet with the sensor and controller attached. The controller section 14 contains an electric circuit for processing the signal from the sensor, an electromagnetic valve for turning the water ON or OFF and a battery which supplies power to these components. The inlet 15 for the electromagnetic valve provided on the underside of the controller section 14 is connected to a pipe 17 leading to the water line by a cap nut 16.

When replacing an ordinary faucet with an automatic type, in most cases, the old faucet is replaced with a faucet with a built-in sensor. An electromagnetic valve is then connected between the faucet and the water shut-off valve, and the controller which processes the signal from the sensor and drives the electromagnetic valve is attached to the lower side of the sink.

In many battery-powered automatic water faucets, the battery is housed within controller section. The controller, electromagnetic valve and sensor of such faucets are usually housed in water-proof structures to prevent entry of water.

When the controller is attached to a wall, it is secured by screws. However, if the wall is a tiled surface, holes have to be drilled in the tiles, which is time consuming and the tiles may also break. For this reason, some automatic water faucets are configured so that the electromagnetic valve and the controller portion are integrated. Such faucets is connected between the faucet and the water supply, or is connected to a water stop valve.

Such configuration has been made possible because the mechanics of the such water faucet have become compact and much lighter. This reduction in size is the result of smaller batteries (made possible because of lower power consumption), the development of compact batteries and the miniaturization of the electric circuits in the controller with greater use of integrated circuit.

Many automatic water faucets are configured so that an electromagnetic valve opens to release water when a hand is detected near the faucet. For this reason, the detector is located near the mouth of the faucet to set to cover the area below the mouth. The signal from the detector is transmitted to the controller by a cable. The electric cable connected to the detecting section passes through the inside of the spout and emerges from the water supply pipe. A connector is attached at the tip of the cables. This connector is connected to the receiving connector which leads to the controller.

The holes in sinks for passing through faucets do not have to be adjusted for sensor faucets as sensor faucets are the same size as ordinary faucets. Often, the faucet hole is larger than the water supply pipe.

To allow for easy connection of the electric cable to the controller, the electric cable is made longer than the section of pipe extending below the faucet in which a screw thread has been cut. When attaching the faucet, the electric cable is first passed through the hole in the sink for attaching faucet from the upper side of the sink. The threaded section of pipe is then passed through the same hole. The special washer for allowing the cable to pass is then screwed onto the threaded section of pipe to firmly hold the faucet in place. A nut is then tightened over the top of this washer. If the special washer is not used, the cable would get in the way, which would prevent the nut from being sufficiently fastened. Accordingly, it is necessary to allow the electric cable to pass between the space provided by the thickness of the special washer. Once the faucet has been fixed to the sink it is connected to the electromagnetic valve.

As the result of the configuration as stated above, when an ordinary manual faucet is exchanged with a sensor type faucet, the manual faucet first has to be removed. This work can be difficult and time-consuming as most sinks are installed up against a wall, with little or no gap between the sink and the wall and positioned near the floor.

Moreover, because of such attachment structure, the exchanging of an old faucet with one of new design or the replacing of a broken sensor is never an easy operation.

In addition, there are many instances where design of the neck portion is chosen in accordance with the interior and/or atmosphere of the room. This means that the faucet is often shipped from the factory with the neck unattached. Thus the ratio of factory-assembled faucets cannot be increased.

SUMMARY OF THE INVENTION

An object of the present invention is to provide an automatic water faucet with a common base in which the faucet portion can be snapped on with one touch.

This eliminates the need for carrying out troublesome attachment work on the spot and makes it possible to select a neck of design that suits the interior of the room. And if the faucet breaks down, it is possible for even a novice to replace the faucet, without having to work underneath the sink.

When conducting such work, the water is shut off even if the water stop valve is not shut, and the sensor can remain connected.

In order to achieve the above-mentioned objectives, in accordance with this invention, there is provided an automatic water faucet wherein the faucet is attached to a sink and opens the water valve in accordance with output of the sensor when it detects a hand and supplies water from the neck, the automatic water faucet comprising: a water faucet having a water path in the central portion thereof, including: a swollen portion with a tapered upper end which houses a water stop body, the tapered upper end; a neck receiving portion, at the upper portion of the water path, continuous to the upper end of the swollen portion and having a diameter that increases at least at two points toward the upper direction; an inside engagement portion engaged to the neck at the upper end of the neck receiving portion; an outside engagement portion disposed concentrically with the inside engagement portion so as to surround the inside engagement portion and engage with the neck; the neck housing a water path within the central portion thereof; a cylindrical projected portion, having sections cut out of it which is in contact with the water stop body included within the swollen portion; a tubular portion provided in a manner continuous to this projected portion and provided with an O ring around the outer circumference thereof; an inside holding portion and an outside holding portion inserted into the water stop seat and held to the inside engagement portion and the outside engagement portion by the repeated rotation thereof and adapted to couple the water path in a water tight manner to the water faucet seat, the neck portion being assembled in a manner integral with the water stop seat.

A projection on the inside of the pedestal and a groove on the faucet side are set so that the neck portion is directed in a predetermined direction after attachment is completed.

Initially, when the projection projected toward the inside of the pedestal and the groove in the axial direction of the faucet are aligned with each other and the faucet is pressed in, the projection reaches the end of the groove in the axial direction so that the faucet cannot be pushed any further in. When this a happens, the O ring provided at the front end of the faucet side reaches the inside diameter of the narrow portion of the pedestal to maintain water tightness. At this point, the projected portion of the front end portion does not reach the valve body so that the water is still held back.

When the faucet is rotated in the clockwise direction at this point, the projection is engaged with the portion of the groove extending in a circumferential direction around the faucet side. Half way along the groove in the circumferential direction again extends in the axial direction. When the faucet side is rotated in the clockwise direction, it stops when it reaches this position.

At this point, the faucet can be pushed down further. When this is done, the second O ring reaches the inside diameter of narrower side of the pedestal to maintain water tightness. In addition, since the projection of the front end portion of the faucet side pushes down the valve within the pedestal portion, water begins to flow.

Since the groove of the faucet side continuously extends in a circumferential direction opposite the direction previously described, it is possible to rotate the faucet side in a counterclockwise direction. As a result, the faucet is stopped at a position at the front. Thus, the faucet is ready for use.

The faucet can be detached easily by conducting operations in reverse order of the above-mentioned operation. The reason the grooves in the circumferential direction are cut into two separate rows (lines) and the reason two O rings are provided will now be described in the case where the faucet is detached.

The faucet is always pushed upward by water pressure from below. When the faucet is first rotated, because the groove and the pawl projected toward the inside are engaged with each other, even if the faucet is pressed down by hand, the faucet cannot be forced back by water pressure. In addition, since the O ring forms a seat, water cannot leak through.

In the case where the faucet is pulled out to the position of the next groove in a circumferential direction when it has reached the groove in the axial direction, the faucet is first pushed back by the water pressure. Thereafter, the projection on the front end portion of the faucet side departs from the valve body. Because of this, the valve body operates to prevent elevation of water pressure. In addition, the second O ring is disengaged, but the first O ring normally functions. For this reason, at least one O ring functions when the valve body shuts off the water.

Then, force is applied so that the faucet is turned along the groove in a circumferential direction. When this is done, since the faucet cannot be pushed or pulled, the valve body cannot be pushed down again and thus can be detached with safety. The faucet can be attached safely by following the reverse order of the above.

In the faucet of the sensor type, hitherto, the neck was fixed to the sink and the connector for connecting the sensor and the controller was attached later.

In this invention, the base is first attached to the sink and the passages for sensor cable are integrally embedded in the base and the neck. In addition, these signal passages are disposed at a position where transmission and reception of signal can be carried out once the faucet is completely connected. Thus, connections of water and signal can be made at the same time. The portions for transmitting the signal are connected while the faucet is rotated. However, there is provided a structure in which contact surfaces are tightly connected when the final position is reached.

BRIEF DESCRIPTION OF THE DRAWINGS

FIG. 18 is a view showing conventional faucet for only allowing water to be passed through.

DESCRIPTION OF THE PREFERRED EMBODIMENTS

Figure 1:
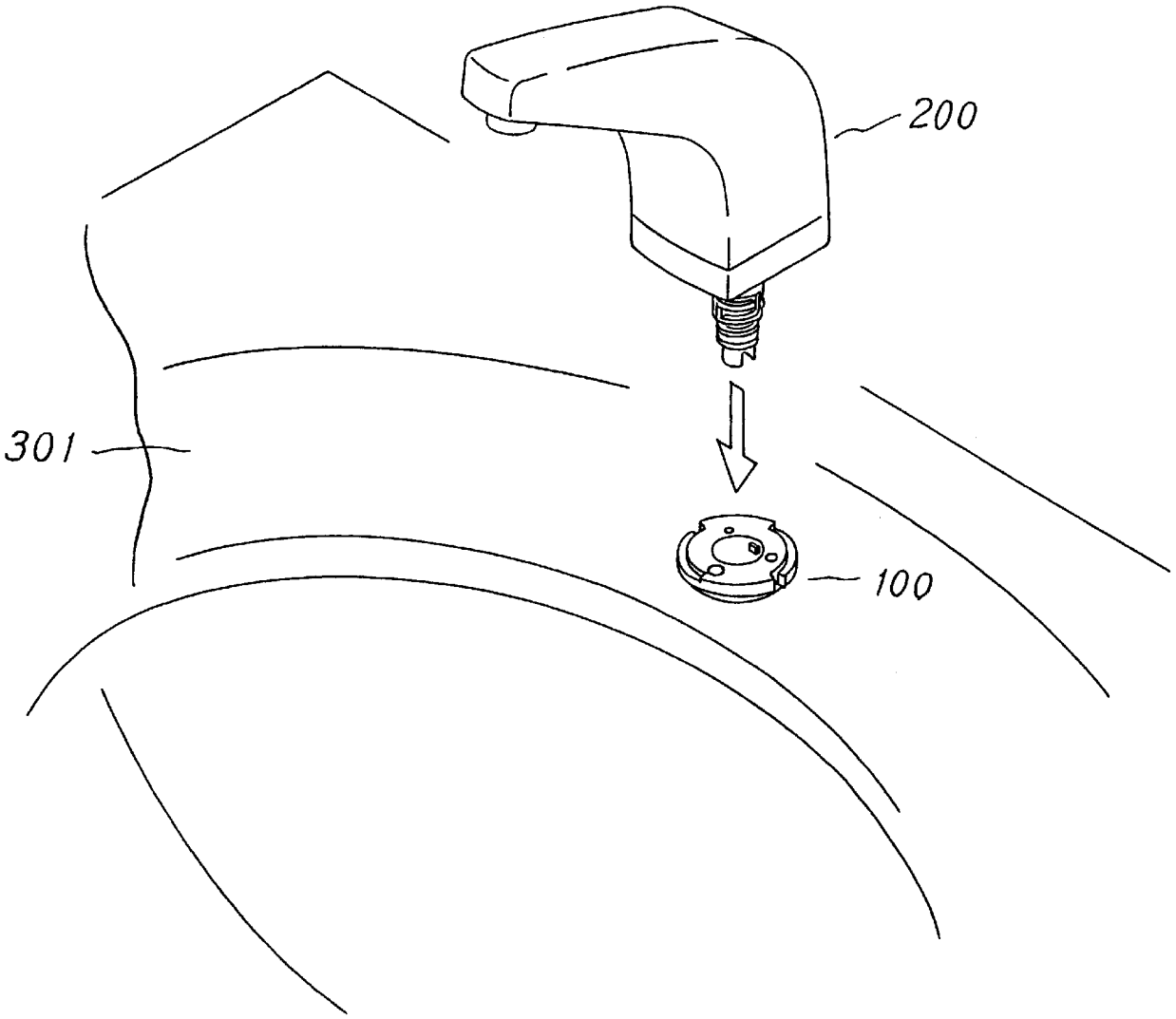
FIG. 1 is an explanatory view showing the state where the neck portion is inserted in an embodiment of this invention.
Figure 2:
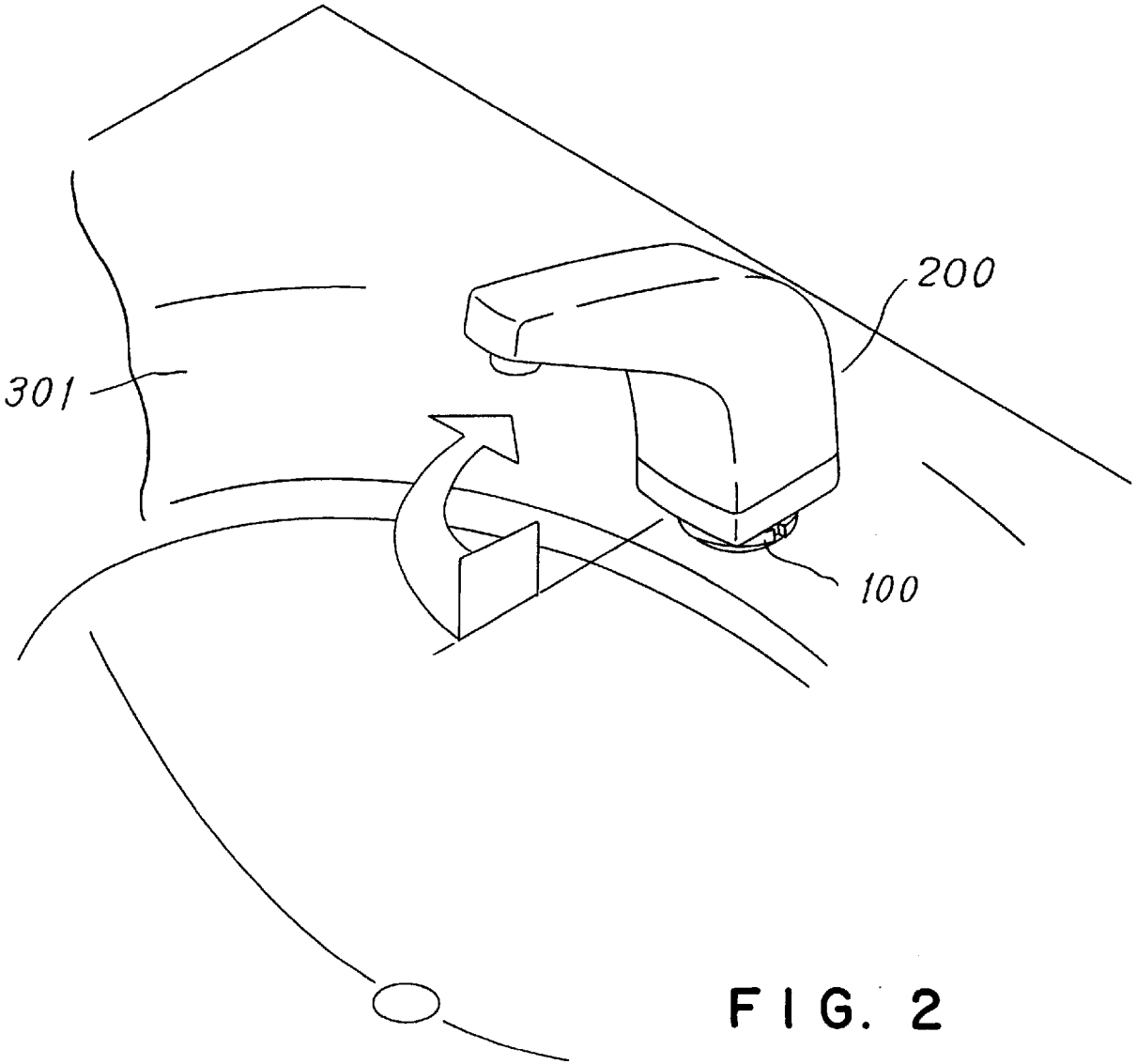
FIG. 2 is an explanatory view showing the state where the neck portion is fitted, which is subsequent to the state of FIG. 1.
Figure 3:
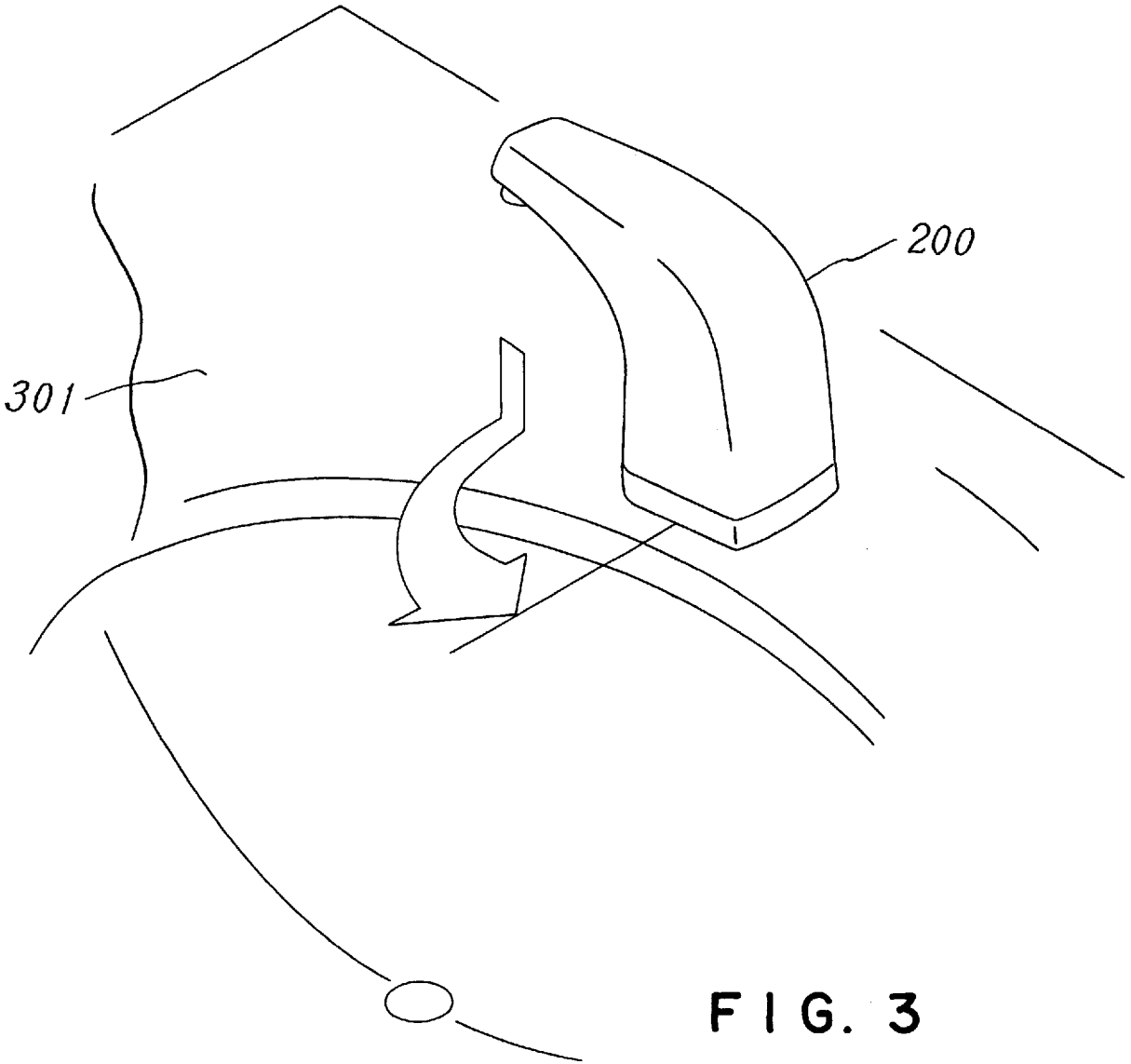
FIG. 3 is a view showing the state where the sensor and the controller section of sensor type automatic water faucet are connected in the embodiment of this invention.

FIGS. 1 to 3 show, by stages, three states in which the neck portion 200 according to this invention is mounted (fitted) to the water faucet base 100 attached to the sink. Namely, as shown in FIG. 1, the lower end of the neck portion 200 is inserted into the water faucet base 100. This base has bayonet attachment mechanism similar to that used in camera lens mounts. Next, as shown in FIG. 2, the neck portion 200 is pushed down over the base and rotated 90 degrees in the clockwise direction. As shown in FIG. 3, the neck portion 200 is then pushed (forced) down one step (stage) further and rotated about 90 degrees in counterclockwise direction.

Figure 19:
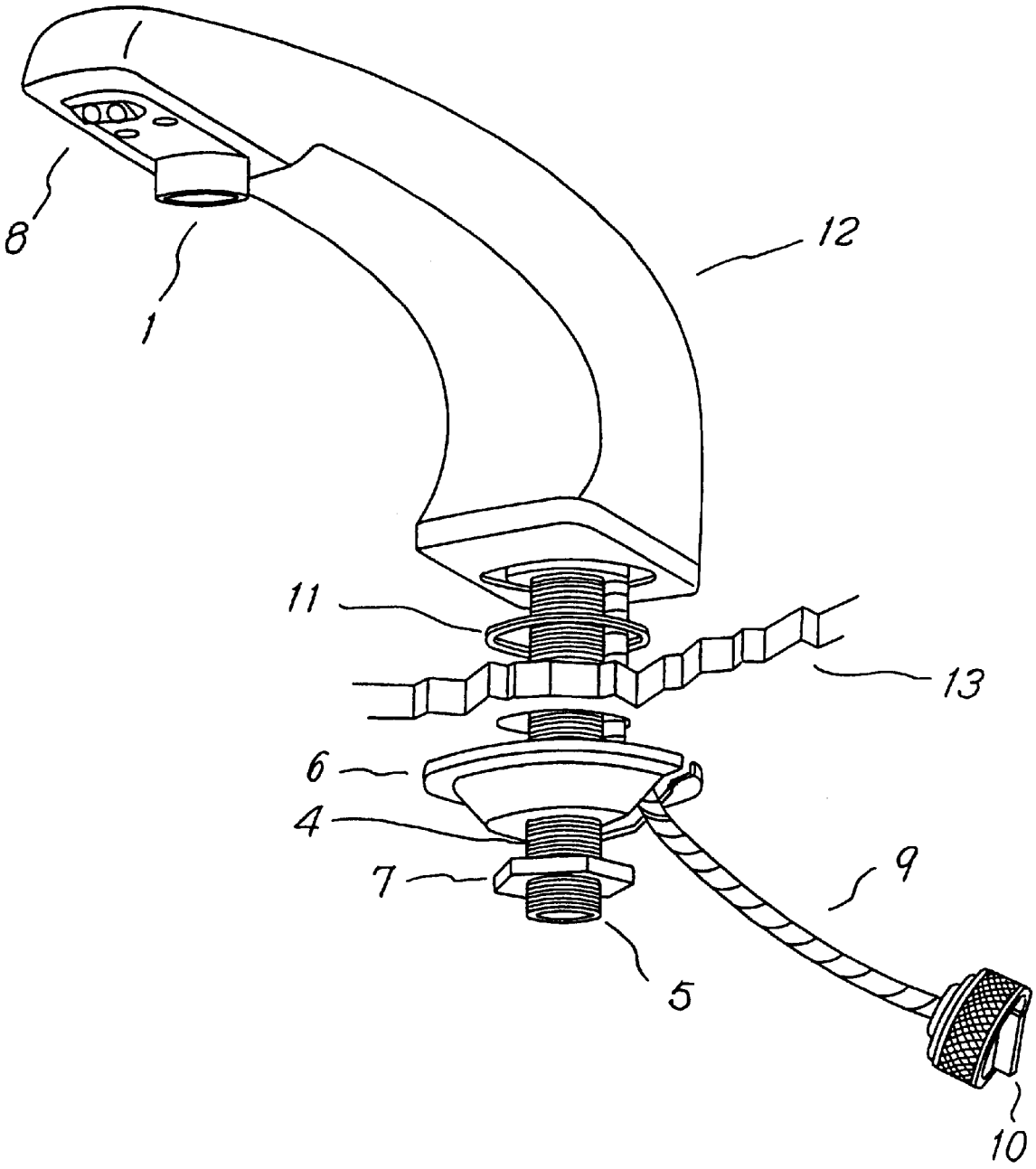
FIG. 19 (PRIOR ART)
FIG. 19 is a perspective view showing a conventional sensor type automatic water faucet attached to a sink.
Figure 20:
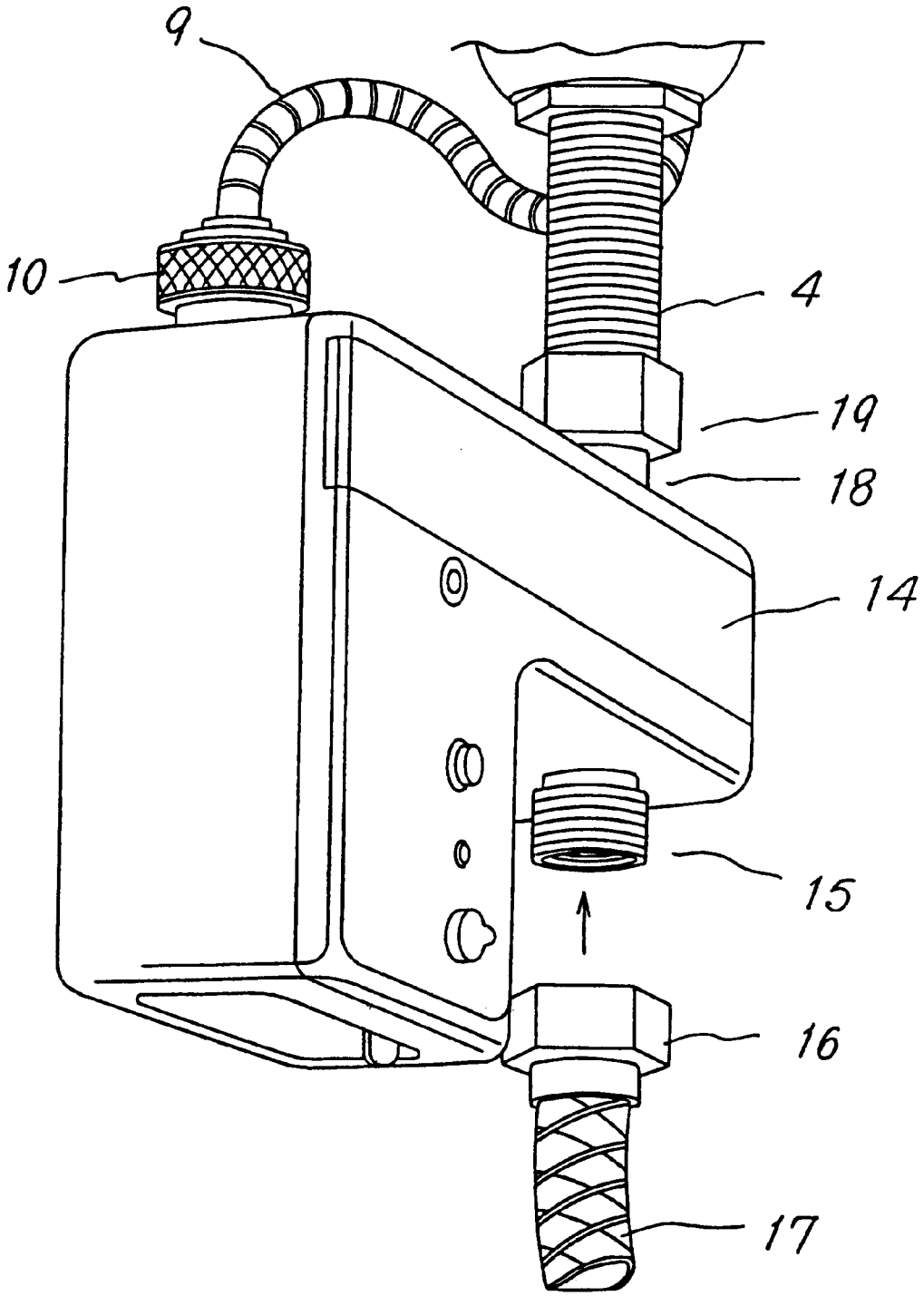
FIG. 20 (PRIOR ART)
FIG. 20 is a view showing the controller portion for the neck portion shown in FIG. 19.

Moreover, the outlet 18 for the electromagnetic valve on the upper side of the controller section 14 is connected to the neck connecting portion 5 (shown in FIG. 19) by a ball-head lock nut 19.

As previously described, this invention relates to structure for attaching manual or automatic water faucet to a sink. Unlike the conventional attachment structure, i.e., a structure whereby a pipe in which screw thread has been cut at the periphery (attached to the manual type faucet or the sensor type automatic water faucet body), is passed through an attachment hole bored in the sink to fix the body portion and the pipe are secured by a nut, in this invention the faucet is divided into the receiving portion which is attached to the sink in advance, and the neck portion which can be attached to the receiving portion later on.

In addition, in the automatic faucet, the conventional passage for sensor signal is built into both the periphery of neck portion, and a portion of the faucet base, thus making for easy connection of the sensor signal line and the water itself.

This connecting portion will now be described in detail.

Figure 4:
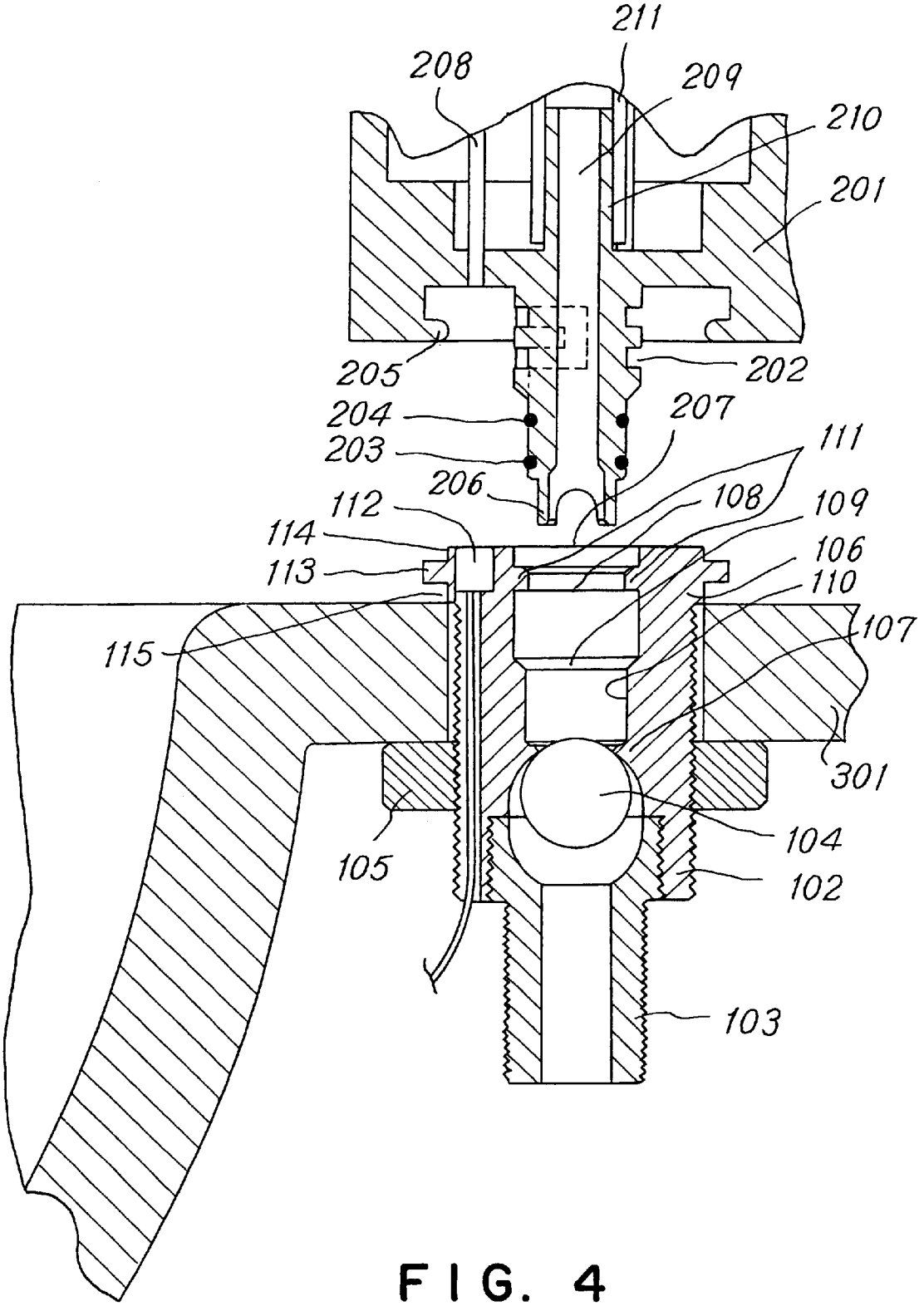
FIG. 4 is a cross sectional view simply indicating the embodiment of this invention.

FIG. 4 shows the state before the joint for this invention has been connected. Reference numeral 301 indicates cross section of the hole for attaching the faucet to a sink (or bowl). Reference numeral 102 indicates the section for attaching to the sink. The spherical body 104, the water stop valve is placed within this section and another section 103 is then screwed into this. A screw thread is cut around the periphery of the attachment section 102, and this section is attached so that the sink 301 is put between a nut 105 and a flange portion 106. A screw thread is also cut around the periphery of the section 103. This section is connected to the water supply pipe. It is necessary that the thread is configured to match the standard configuration for water pipes.

When the water stop valve body 104 is subject to water pressure from the water supply side, it seals against the receiving seat portion 107 contained within the section 103 thereby shutting off the water. The inside of the attachment section 102 is continuous to a lead in portion 108, and is continuous to a guiding portion 109 and a coupling portion 110. At the portion of the lead in portion 108, a pair of projections 111 are provided. These projections 111 engage with grooves 202 of the neck portion so that they are securely coupled, and prevent detachment. The coupling portion 110 has inside diameter smaller than that of the lead in portion 108, and is fitted into the first O ring 203 and the second O ring 204 of the neck portion to prevent leakage of water. The guiding portion 109 is the portion connecting the lead in portion 108 and the coupling portion 110, and is angled so that the neck portion can be easily inserted.

An infrared light receiving portion 112, which acts as the sensor, is accommodated within a hole bored in the attachment member. An electric lead wire is connected to the light receiving portion 112. An infrared light emitting section (not shown) and visible light emitting section (not shown) for indicating sensor activity are also provided.

The faucet in FIG. 4 has the infrared sensor element disposed in the attachment surface and is coupled with optical fiber in the neck portion. The faucet may also be configured for optical fiber cable-optical fiber cable, or electric lead wire-electric lead wire.

A flange 113 is provided so that the pair of pawls 205 in the neck portion are engaged. Notches corresponding to the pawls 205 are provided in the neck portion 200. The pawls 205 are guided into a fastening portion 115. Reference numeral 114 denotes a guiding portion which makes the joint easy to couple.

The configuration of the neck portion 200 side will now be described.

A projected portion 206 provided at the lower end of the neck portion 200 serves to push down the water stop valve body 104 when coupled thereby allowing the water to flow from the cut-out portion 207. An optical fiber 208 provided above this projected portion 206 leads infrared rays to the infrared light receiving element 112.

When other cross section is viewed, optical fibers are respectively provided at positions corresponding to the infrared light emitting element and the display light emitting element on the sink side. Reference numeral 209 indicates a passage for water, reference numeral 211 indicates a pipe connected to mouth of the neck portion, and reference numeral 210 indicates the connecting portion for the pipe.

In FIG. 4, the mouth of the neck portion and the sensor head portion (exit for the optical fiber) have been omitted. The connecting portion and other portions of the neck portion may be separately made up and added later.

Figure 5:
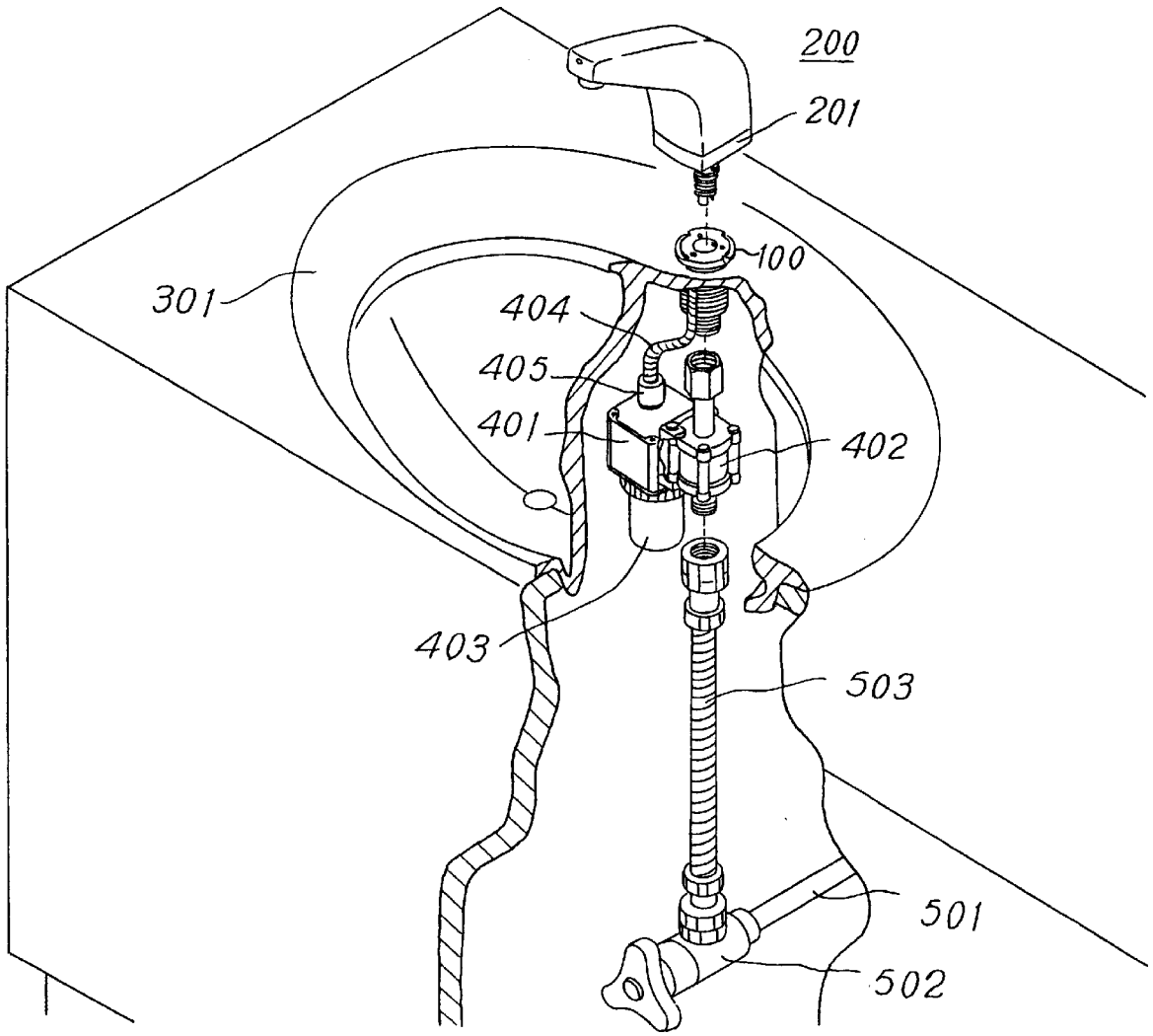
FIG. 5 is a partial cross sectional view in the case where the faucet according to an embodiment of this invention is attached to a sink.

FIG. 5 indicates the installation of the automatic water faucet to a sink. Reference numeral 301 indicates the sink (BOWL), 200 indicates the entire neck portion, 100 indicates the joint on the sink side, 401 indicates the sensor processing circuit, 402 indicates the electromagnetic valve section, and 403 denotes the battery box. The sensor processing circuit section 401, the electromagnetic valve portion 402 and the battery box 403 form a single body.

Water from the water line is supplied to the electromagnetic valve 402 via a water supply pipe 501, a water shut-off 502 and a water supply pipe 503. The electromagnetic valve in the electromagnetic valve portion 402 opens and closes in accordance with the signal from the sensor processing circuit section 401. The battery box portion 403 supplies power to the sensor, the sensor processing circuit, and the electromagnetic valve. Wires for the infrared transmitter, the infrared receiver and the indicator light are combined into a single cable, connected to the sensor processing circuit section 401 by a connector 405.

Figure 6:
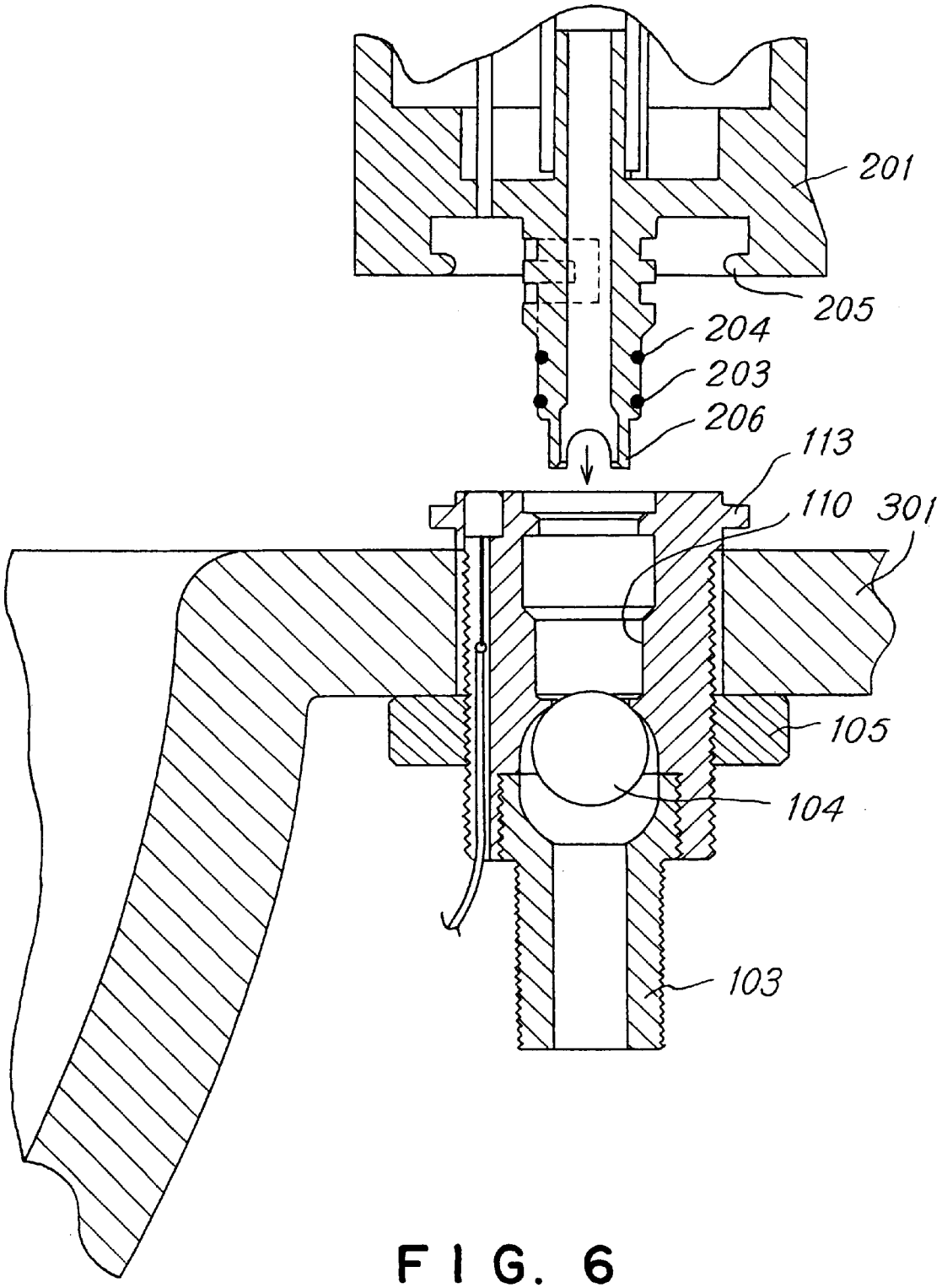
FIG. 6 is a view for explaining the stage before for connecting the faucet in an embodiment of this invention.
Figure 7:
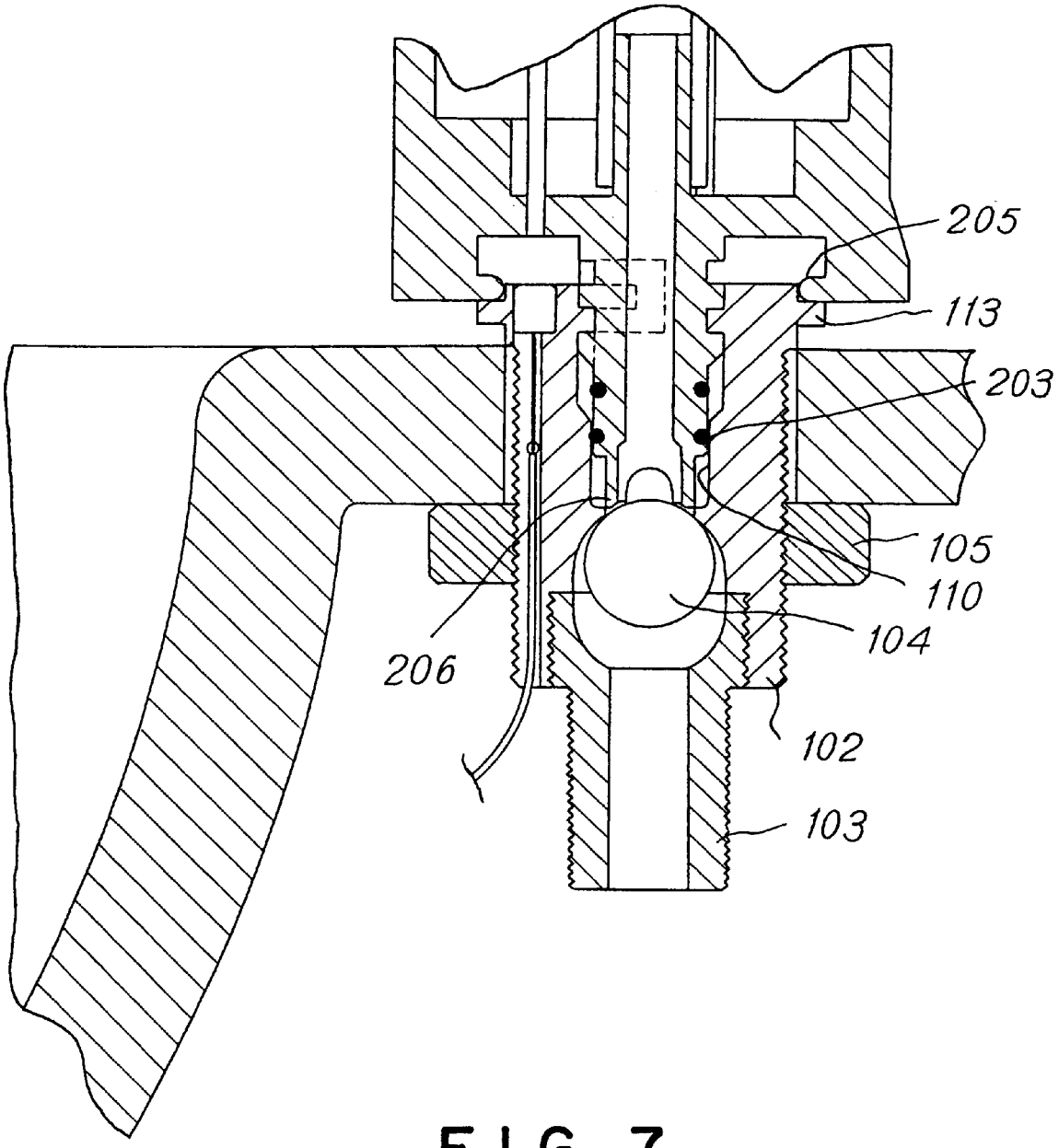
FIG. 7 is a view showing the state where the faucet in an embodiment of this invention is inserted into the first groove in the axial direction.

FIGS. 6 to 17 are views for explaining the stages leading up to the connection of the neck portion. FIG. 6 shows the state before connection, whereas FIG. 7 shows the state where the neck portion is inserted until the depth of the first groove in the axial direction. At this point the first O ring 203 reaches the coupling portion 110, thus preventing water from leaking. In this position, the neck portion is still not in contact with the water stop valve body 104. In this position the cross section shows that the positions for the infrared receiver and the optical fiber are aligned with each other even when the neck portion has been completely coupled.

Figure 8:
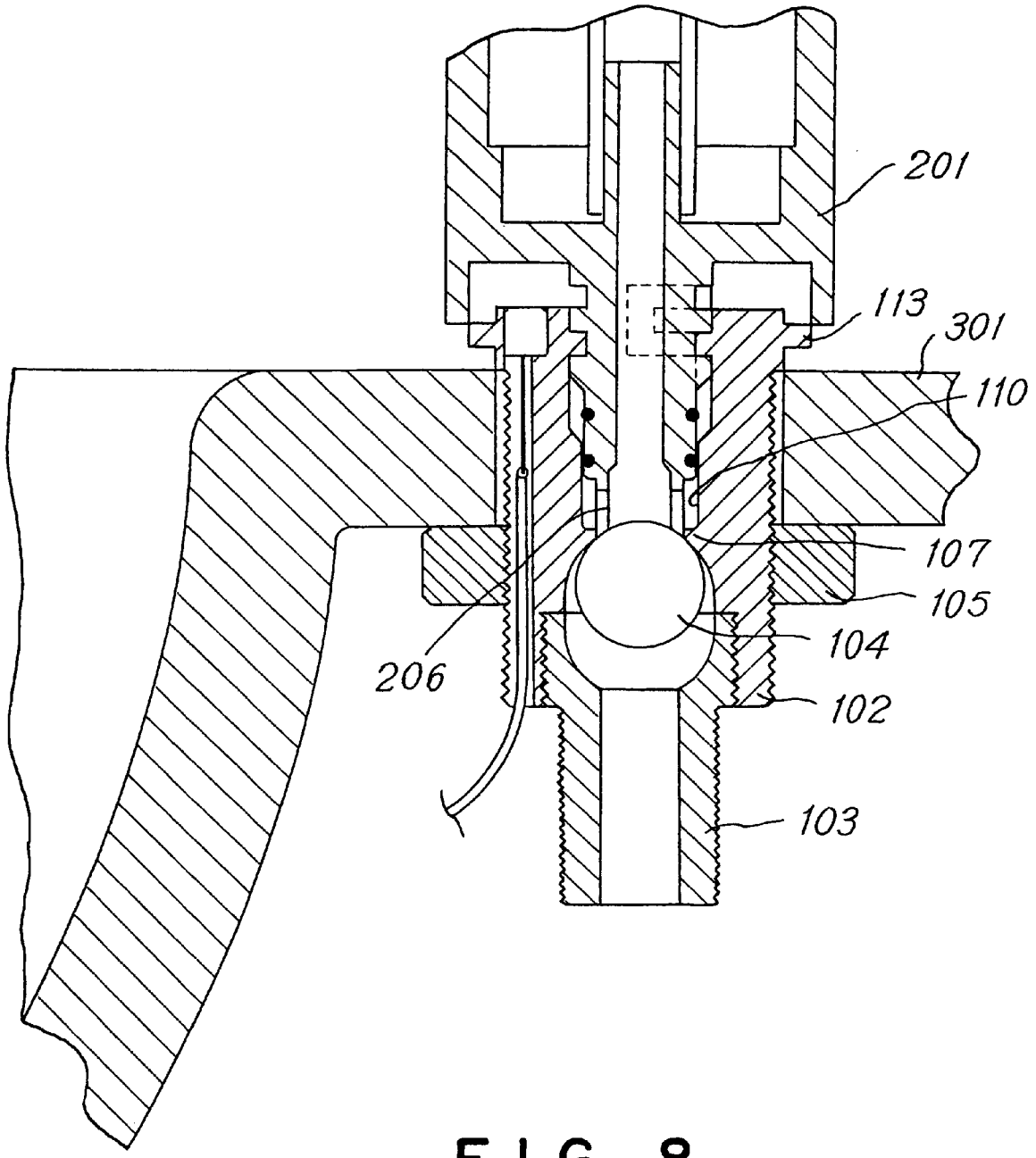
FIG. 8 is a view showing the state where the faucet in an embodiment of this invention is rotated along the first groove in a circumferential direction.

FIG. 8 shows the state of the faucet when the neck portion has been rotated until stopping along the first groove in the circumferential direction at the position indicated in FIG. 7. The depth of insertion is the same as that for FIG. 7. Since the neck portion has been rotated by 90 degrees, the infrared receiver and the optical fiber are out of alignment. An O ring is required to further prevent the leakage of water even though the water has been shut off by the ball because water overflows at the moment the water is shut off by the ball.

Figure 9:
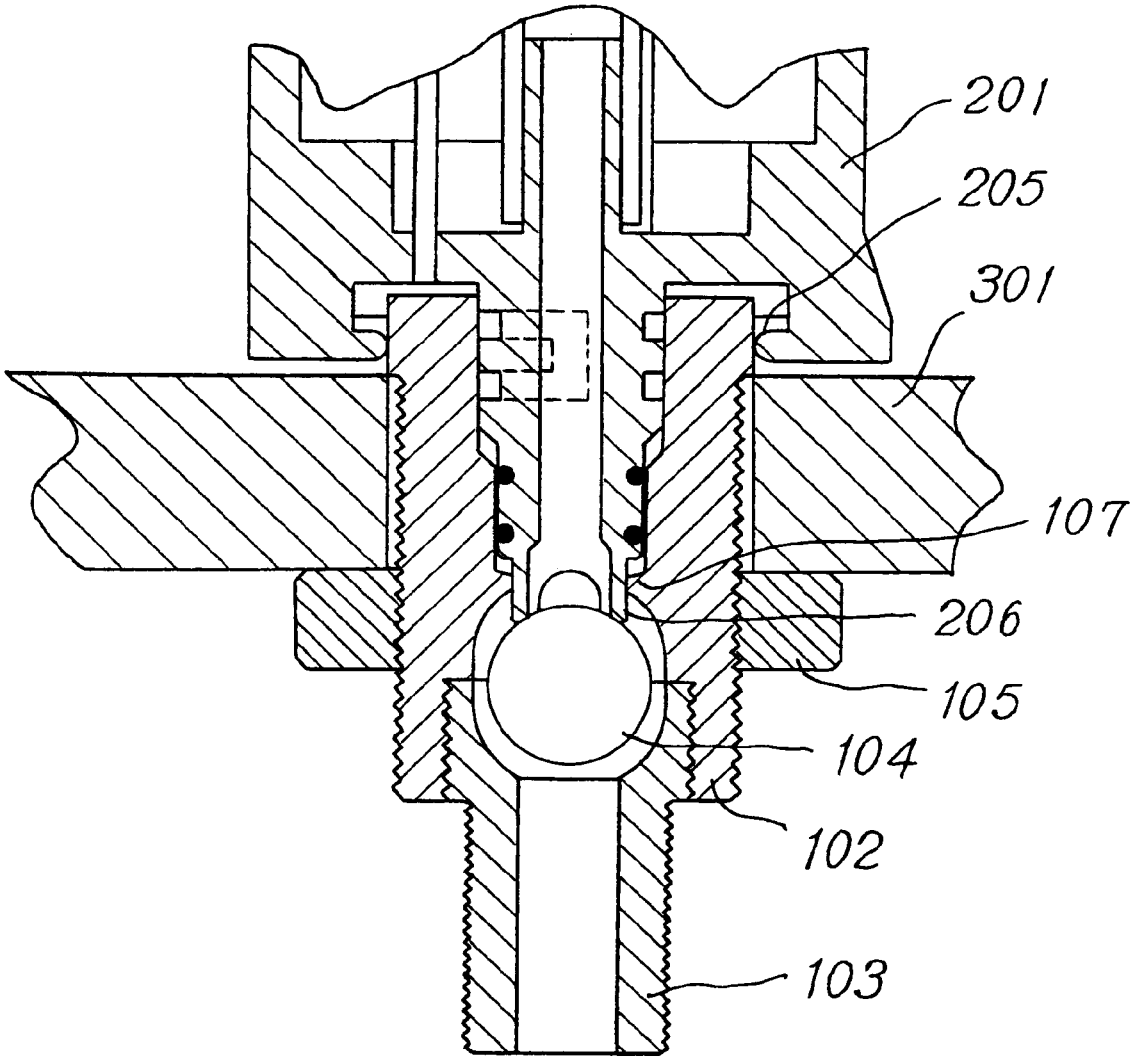
FIG. 9 is a view showing the state where the faucet according to an embodiment of this invention is inserted until the middle portion of the second groove in the axial direction.

FIG. 9 shows the state of the faucet when the neck portion has been pushed in the axial direction half way along the second groove. When the second O ring 204 reaches the coupling portion 110, the projected portion 206 comes into contact with the water stop valve body 104, thereby allowing the faucet to be made water tight with safety.

Figure 10:
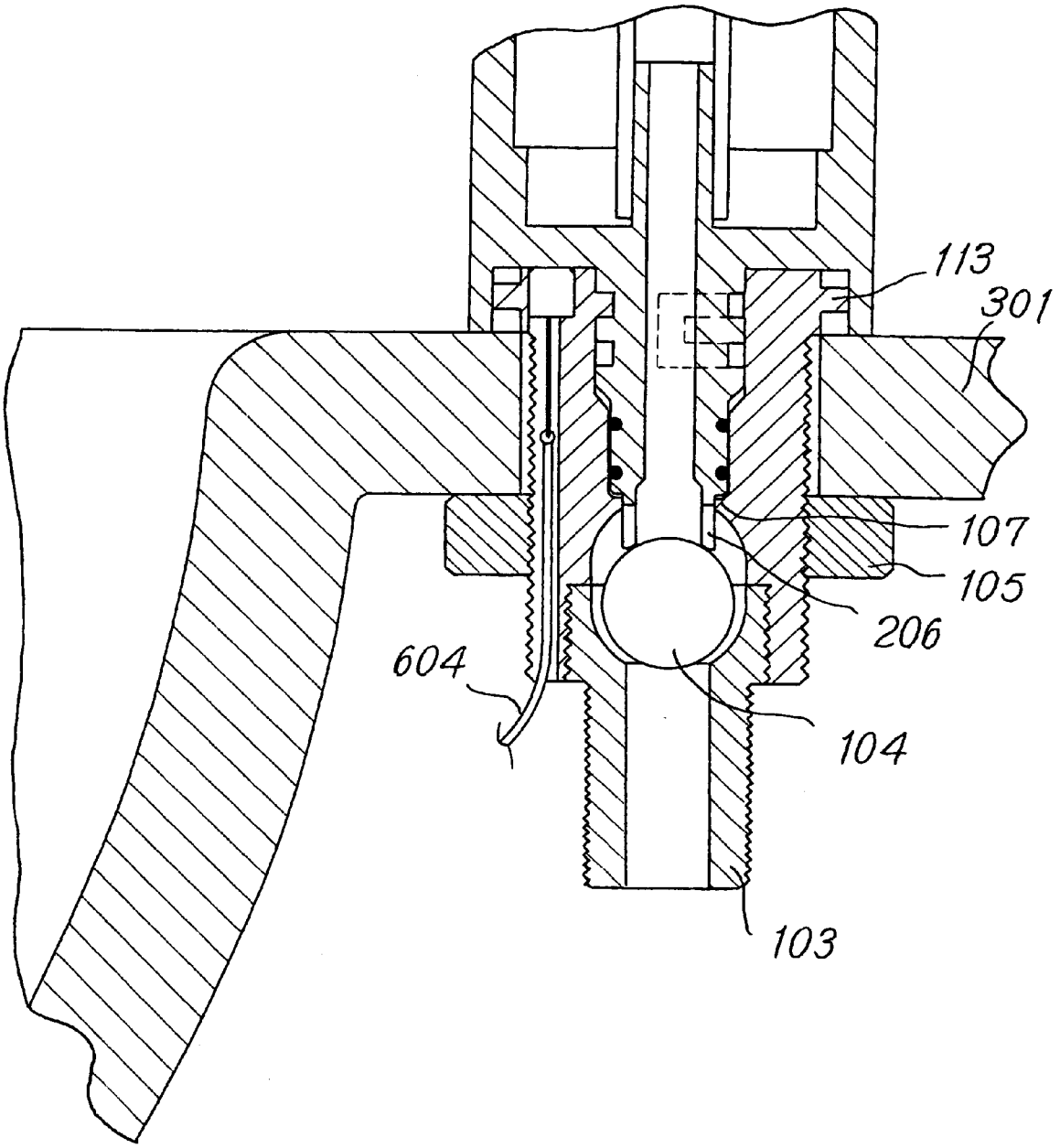
FIG. 10 is a view showing the state where the faucet according to the embodiment of this invention is inserted until the end of the second groove in the axial direction.

FIG. 10 shows the state of the faucet when the neck has been inserted to the depth of the second groove. In this position, the water stop valve body is completely pushed down, so the water flows freely.

Figure 11:
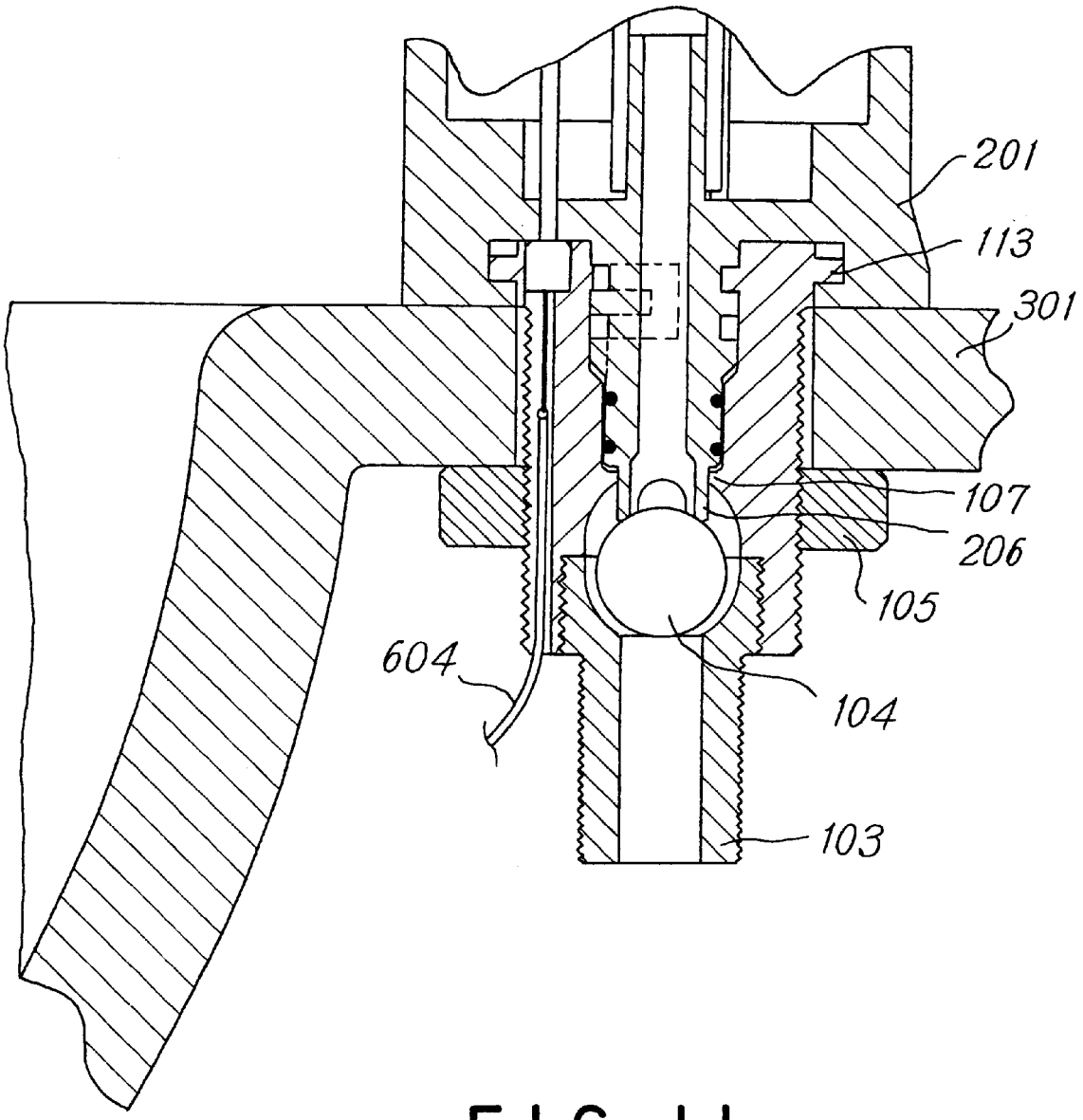
FIG. 11 is a view showing the state where the faucet according to an embodiment of this invention is rotated until the end of the second groove in the circumferential direction (the state where attachment has been completed).

FIG. 11 shows the state of the faucet when the neck portion is rotated in the circumferential direction to the end of the second groove. In this position, the neck portion is set at the predetermined depth of insertion and direction, thus completing the connection of the joint.

Figure 12:
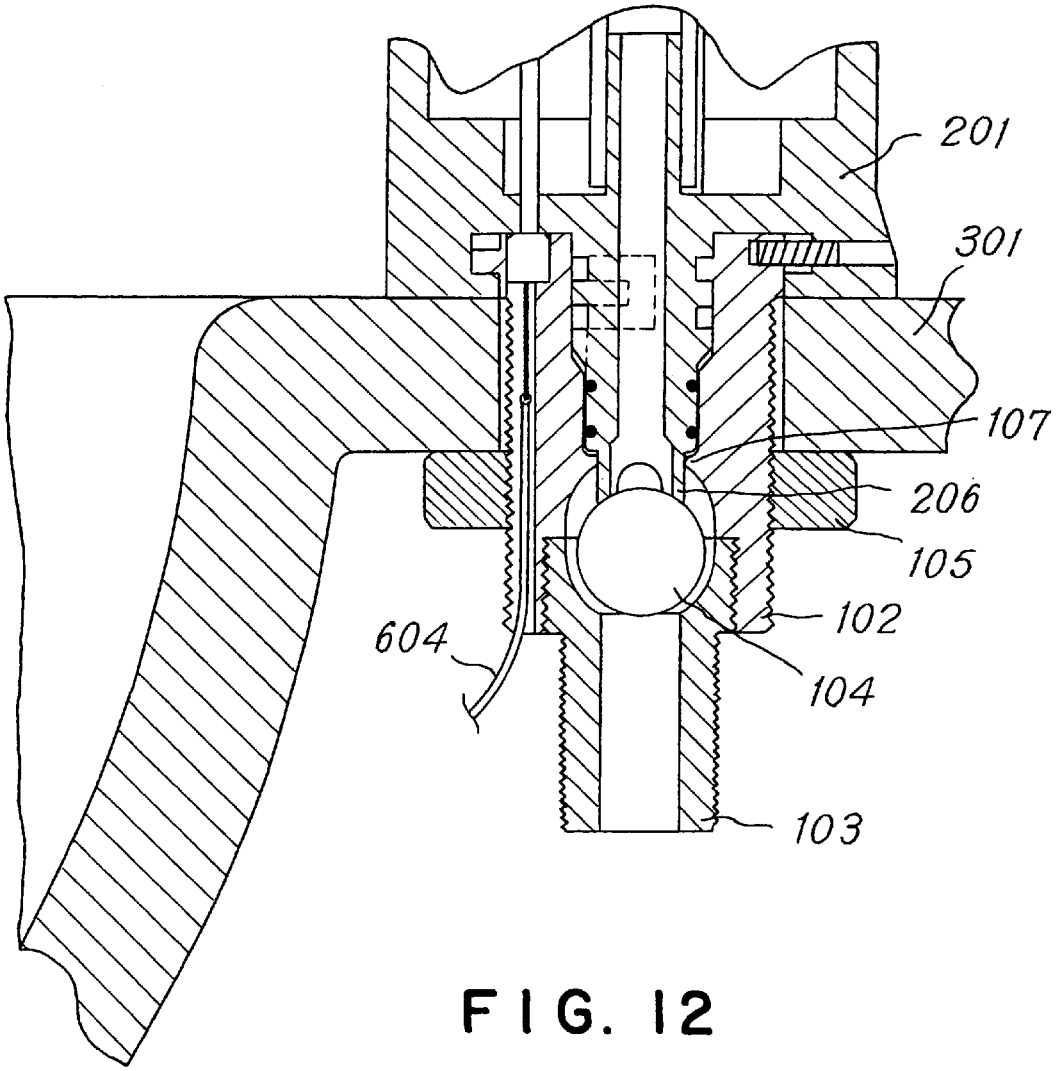
FIG. 12 is a view showing concealed lock mechanism for stopping rotation in an embodiment of this invention.
Figure 13:
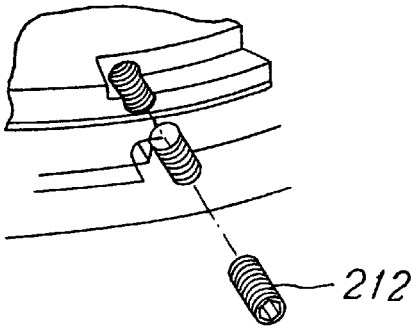
FIG. 13 is a view showing the fitting of a square bolt used in conceal the lock mechanism in FIG. 12.

FIGS. 12 and 13 show a concealed locking mechanism for preventing theft of the neck portion. As shown in FIG. 12, when the neck portion is fully connected, holes in the attachment members 102 and 201 line up with each other. Rotation of the neck can be prevented by inserting a square bolt, thereby preventing detachment and theft.

Figure 14:
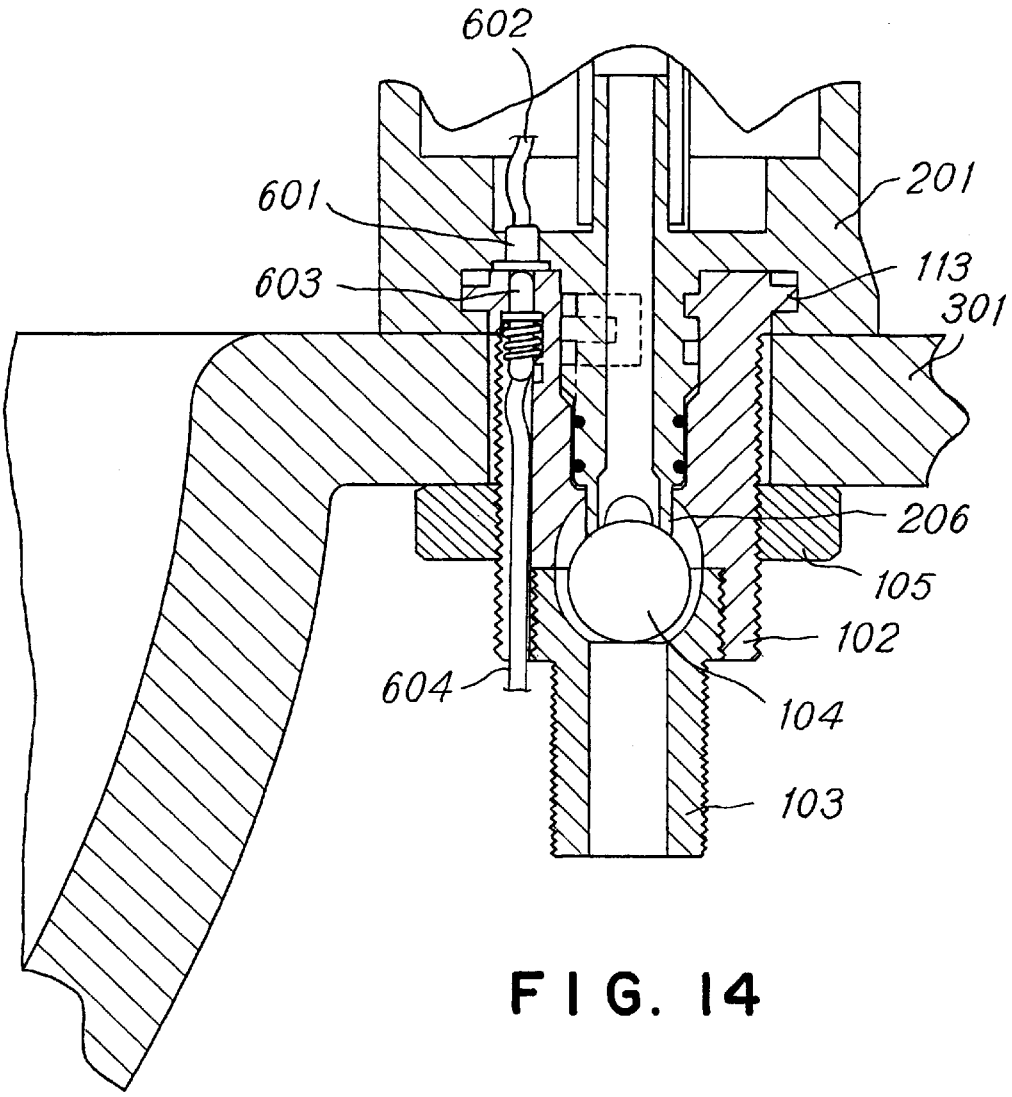
FIG. 14 is a view showing the case where signal of the connector portion is an electric signal in an embodiment of this invention.
Figure 15:
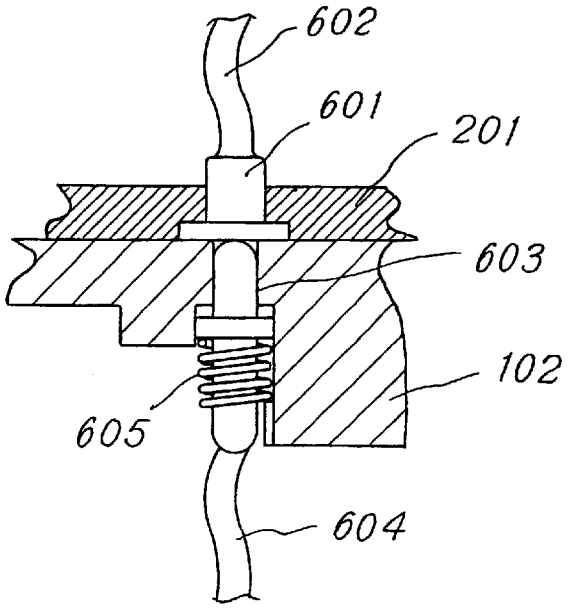
FIG. 15 is an enlarged view of the connector portion in FIG. 14.

FIGS. 14 and 15 indicate connection of the electronic signal cable. At the neck portion 201, an electrode 601 is attached. This electrode 601 is connected to the infrared transmitter in the neck portion by an electric lead wire 602. At one side of attachment member 102, an electric contact 603 is pushed up against the neck portion by a spring 605. This electric contact 603 is connected to processing circuit by an electric lead wire 604. Electrode 601, electric lead wires 602, 604 and electric contact 603 and spring 605 are insulated from the other members, although this is not shown in FIGS. 14 and 15.

When the neck portion 201 is detached, the tip of the contact 603 is pushed up by the spring 605 so that it protrudes slightly above the attachment surface.

Figure 16:
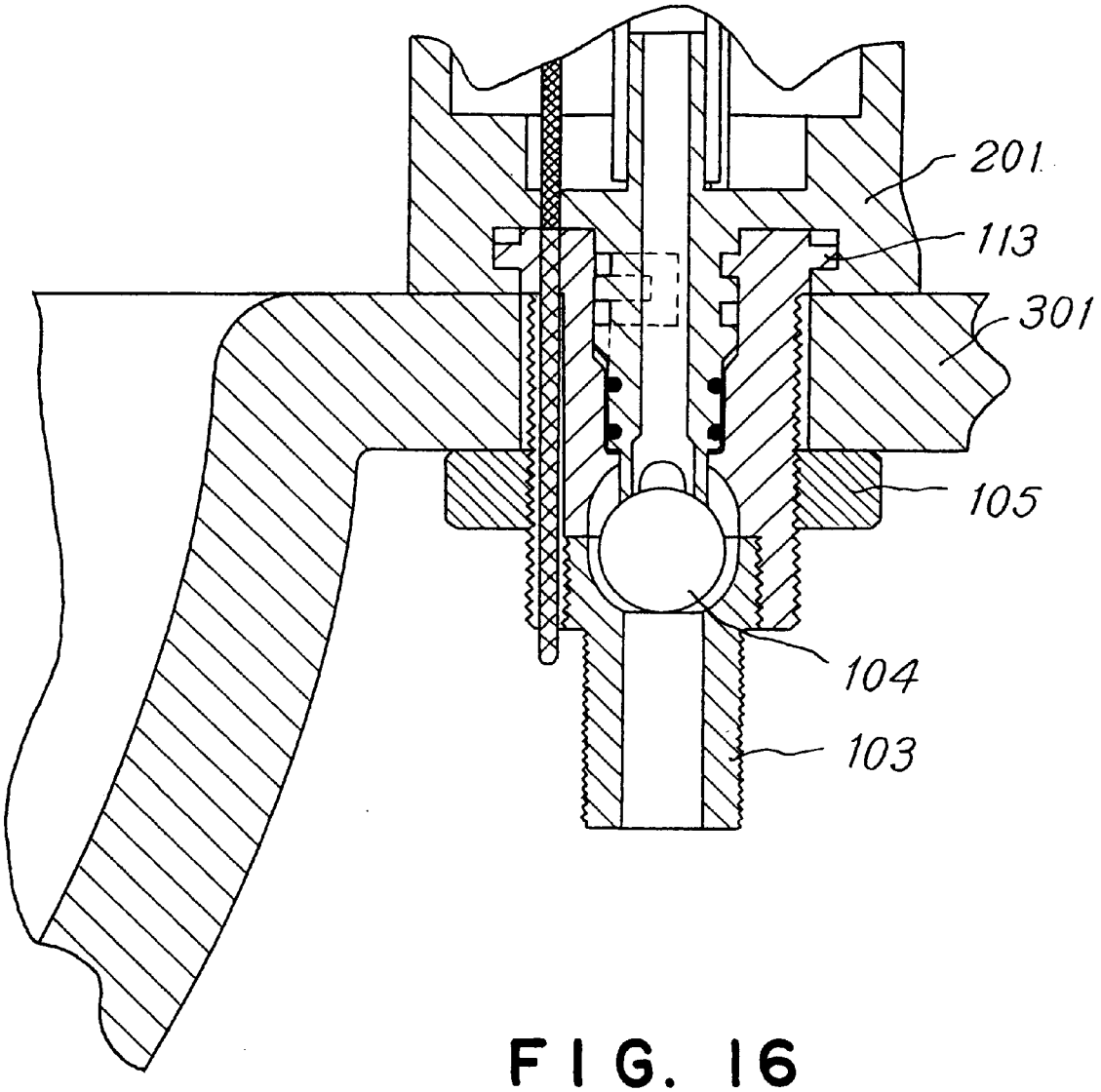
FIG. 16 is a view showing the case where connector portion of signal connected by optical fibers in an embodiment of this invention.

FIG. 16 indicates the faucet when optical fibers form the signal cable. A lens may be interposed to improve the efficiency of transmission. As in FIG. 15, a spring may be used to force the contacts tightly against each other.

Figure 17:
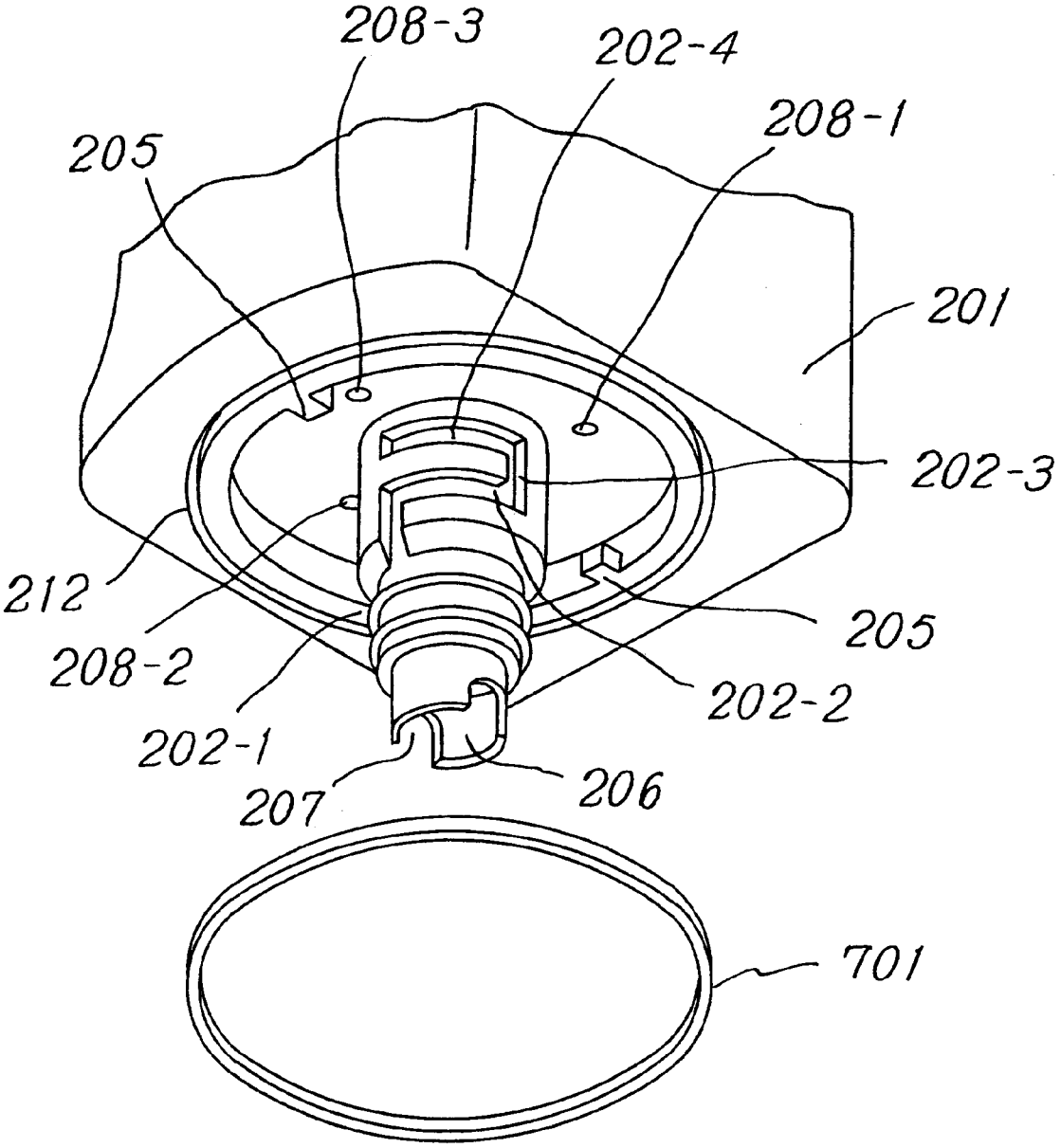
FIG. 17 is a view showing the example where a water tight O ring is attached in an embodiment of this invention.
Figure 18:
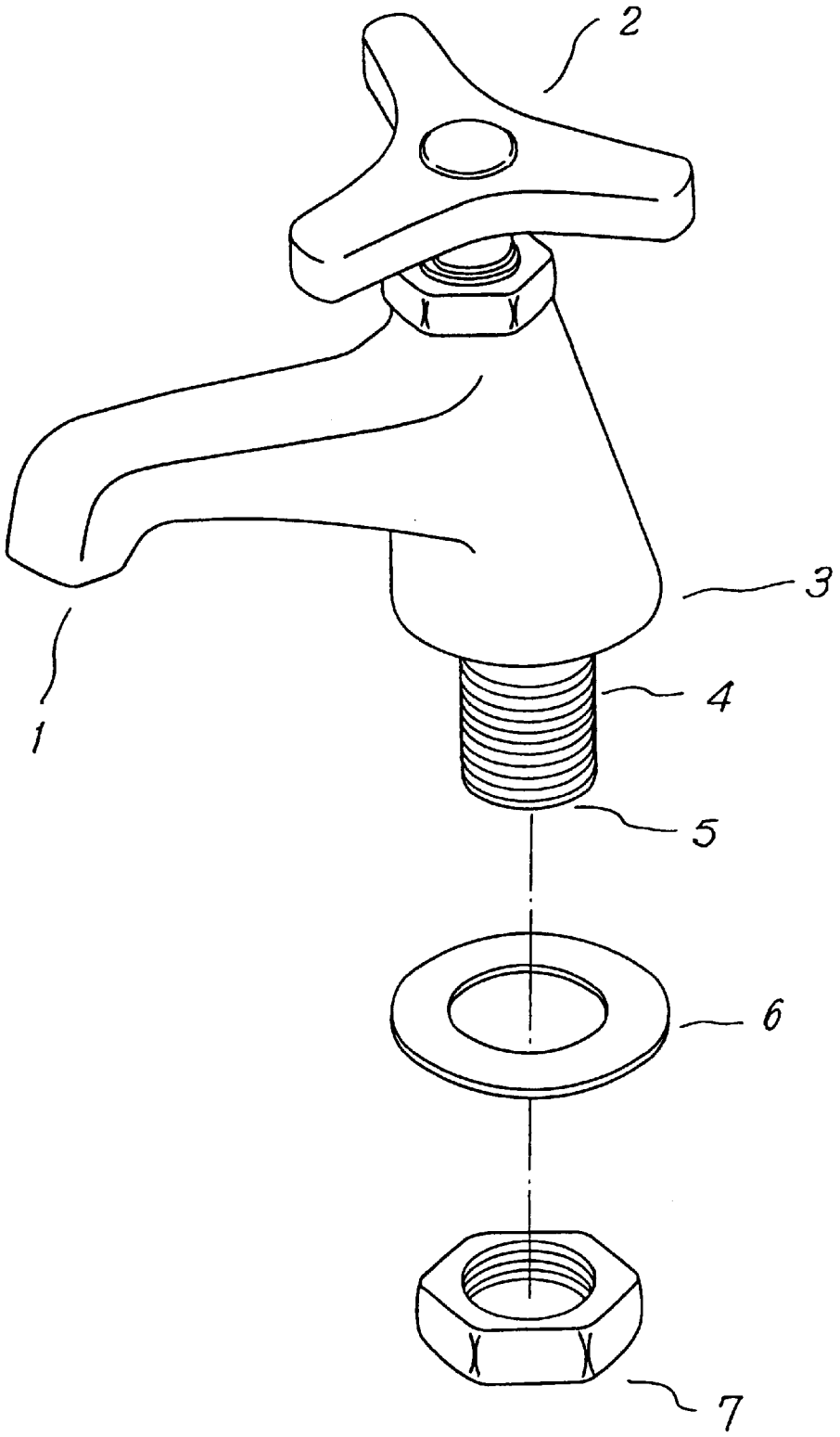
FIG. 18 (PRIOR ART)

FIG. 17 indicates the underside of the neck portion 201. The O ring 701 is inserted into the groove 212 of the neck portion 201 to prevent water from entering under the neck.

By engaging projections 111 with grooves 202-1, 202-2, 202-3 and 202-4, the three stages of attachment of the neck portion 200 (as indicated in FIGS. 1 to 3) can be achieved. Namely, the first stage is the insertion of the lower end of the neck portion 200. This is done by aiming at the central position of the water faucet seat 100. As shown in FIG. 1, the water faucet seat has an attachment mechanism similar to the bayonet attachment system used for mounting a lens in camera. In the second stage the neck portion 200 is pushed down over the faucet and rotated by about 90 degrees in the clockwise direction as shown in FIG. 2. In the third stage the neck portion 200 is pushed down further and rotated by about 90 degrees in the counterclockwise direction as shown in FIG. 3.

What is claimed is:

1. An automatic water faucet which is attached to a sink and which opens a valve in accordance with the output of a sensor detecting the proximity of a hand to supply water from a mouth of the faucet, the automatic water faucet comprising:

a water faucet seat fixedly attached to the sink including: a water path at the central portion thereof, a swollen portion within the swollen portion of the water path, housing a water shut-off body and having a tapered upper end; a neck receiving portion, the upper portion of the water path continuous to the upper end of the swollen portion, and having a diameter that increases at least two points toward the upper direction; an internal engagement portion that engages with the neck at the upper end of the neck receiving portion; an external engagement portion disposed concentrically with the internal engagement portion so as to surround the internal engagement portion and to engage with the neck; wherein the internal engagement portion and the external engagement portion are each integrally constructed with the water path, and the water shut-off body does not include a spring; and a neck portion including: a water path at the central portion thereof; a cylindrical projected portion at the lower end having sections cut out of it a portion that contacts the water shut-off body housed in the swollen portion; a tubular portion provided continuously to this projected portion and provided with an O ring around the outer circumference thereof; an inside holding portion and an outside holding portion inserted into the water faucet seat and held to the internal engagement portion and the external engagement portion by the repeated rotation thereof and which couples the water path to the water faucet seat in a water tight manner, the neck portion being assembled integrally with the water faucet seat.

2. An automatic water faucet as set forth in claim 1, wherein the engagement portion and the holding portion have bayonet mechanism.

3. An automatic water faucet as set forth in claim 2, wherein a concealed locking mechanism is provided within the bayonet mechanism.

4. An automatic water faucet as set forth in claim 1, which comprises a signal transmission path for carrying out transmission/reception of signals between the water faucet seat and the neck portion.

5. An automatic water faucet as set forth in claim 4, wherein the signal transmission path is constituted by optical fiber.

6. An automatic water faucet as set forth in claim 4, wherein the signal transmission path is constituted by insulated electric conductor.

7. An automatic water faucet as set forth in claim 4, wherein the signal transmission path is constituted by a combination of an optical fiber and a light emitting/light receiving device.

* * * * *